US010943758B2

(12) United States Patent
Smith et al.

(10) Patent No.: US 10,943,758 B2
(45) **Date of Patent: *Mar. 9, 2021**

(54) IMAGE INTENSIFIER WITH THIN LAYER TRANSMISSION LAYER SUPPORT STRUCTURES

(71) Applicant: ELBIT SYSTEMS OF AMERICA, LLC, Fort Worth, TX (US)

(72) Inventors: Arlynn W. Smith, Blue Ridge, VA (US); Dan Chilcott, Buchanan, VA (US)

(73) Assignee: ELBIT SYSTEMS OF AMERICA, LLC, Fort Worth, TX (US)

( * ) Notice: Subject to any disclaimer, the term of this patent is extended or adjusted under 35 U.S.C. 154(b) by 35 days.

This patent is subject to a terminal disclaimer.

(21) Appl. No.: 16/449,142

(22) Filed: Jun. 21, 2019

(65) Prior Publication Data

US 2020/0402757 A1 Dec. 24, 2020

(51) Int. Cl.

| | |
|---|---|
| ***H01J 21/10*** | (2006.01) |
| ***H01J 9/02*** | (2006.01) |
| ***H01J 19/42*** | (2006.01) |
| ***H01J 19/24*** | (2006.01) |

(52) U.S. Cl.

CPC ..... *H01J 21/105* (2013.01); *H01J 9/025* (2013.01); *H01J 19/24* (2013.01); *H01J 19/42* (2013.01)

(58) Field of Classification Search

CPC .. H01J 21/105; H01J 9/025; H01J 9/24; H01J 9/42

See application file for complete search history.

(56) References Cited

U.S. PATENT DOCUMENTS

| | | | | |
|---|---|---|---|---|
| 5,349,177 | A | 9/1994 | Thomas et al. | |
| 10,163,599 | B1 * | 12/2018 | Smith | H01J 9/125 |
| 10,312,047 | B1 * | 6/2019 | Smith | H01J 31/506 |
| 10,332,732 | B1 * | 6/2019 | Smith | H01J 31/50 |

(Continued)

OTHER PUBLICATIONS

Van Der Graaf, H., et al., "The Tynode; a new vacuum electron multiplier for ultra fast pixelised particle detectors with sufficient yield; enabling the construction of TipsyZero," CTD+WIT 2017, Orsay, France (Mar. 6, 2017).

(Continued)

*Primary Examiner* — Christine A Enad
(74) *Attorney, Agent, or Firm* — K&L Gates LLP

(57) ABSTRACT

A light intensifier includes a semiconductor structure to multiply electrons and block stray particles. A thin gain substrate layer includes an electron multiplier region that is doped to generate a plurality of electrons for each electron that impinges on an input surface of the gain substrate layer and blocking structures that are doped to direct the plurality of electrons towards emission areas of an emission surface of the gain substrate layer. Respective ribs of a first plurality of ribs on the input surface of the gain substrate layer are vertically aligned with respective blocking structures, and respective blocking structures are vertically aligned with respective ribs of a second plurality of ribs at the emission surface. This alignment directs electrons along a path through the gain substrate layer to reduce noise. The support ribs provide mechanical strength to the gain substrate layer, improving robustness of the light intensifier while minimizing noise.

20 Claims, 10 Drawing Sheets

(56) References Cited

U.S. PATENT DOCUMENTS

| | | | | |
|---|---|---|---|---|
| 10,734,184 | B1 * | 8/2020 | Smith | H01J 31/507 |
| 2004/0189166 | A1 * | 9/2004 | Smith | H01J 1/32 313/103 R |
| 2010/0039014 | A1 * | 2/2010 | Kim | H01J 43/22 313/103 R |

OTHER PUBLICATIONS

Buckles, R., et al., "Next-Generation Photomultiplier Detectors Using Transmissive III-Nitride Semiconductor Electrodes NLV-049-16, Year 3 of 3," Site-Directed Research and Development Annual Meeting, Las Vegas, Nevada (Sep. 26, 2018).

International Search Report and Written Opinion issued in PCT/US2020/038119 dated Sep. 15, 2020, 12 pages.

* cited by examiner

IMAGE INTENSIFIER WITH THIN LAYER TRANSMISSION LAYER SUPPORT STRUCTURES

BACKGROUND

Image intensifiers typically include a photocathode layer and an electron multiplier. Generally, the photocathode layer converts incoming photons into electrons and the electron multiplier (transmission layer) generates multiple electrons from each single electron received from the photocathode layer. Often, the electron multiplier (gain layer) utilizes electron impact ionization as a gain mechanism to amplify electrons generated by the photocathode layer in response to incoming photons.

Unfortunately, image intensifiers that rely on electron impact ionization as a gain mechanism often experience performance degradation when electrons move along undesirable paths prior to or subsequent to an impact. For example, if electrons backscatter (reflect or bounce) off a surface of the electron multiplier, these backscattered electrons may create a halo effect that degrades image quality. Additionally or alternatively, some electrons, including backscattered electrons, may be lost between the photocathode layer and the electron multiplier (i.e., if the electrons are absorbed by a structure other than the electron multiplier). Still further, electrons may move laterally within the electron multiplier, thereby degrading the spatial fidelity of the electrons that are output by the electron multiplier. Thus, crosstalk between pixels or adjacent regions in the gain layer may cause performance degradation. To minimize performance degradation, the thickness of the gain layer is often minimized. However, a thin gain layer is susceptible to failure from mechanical breakage or other processes such as deflection from pressure differentials between cavities or from applied voltages between different layers.

FIG. 1 shows an example of an image intensifier, in this case, a CERN Tynode, which includes thin transmission layers to minimize performance degradation (see, https://indico.cern.ch/event/577003/contributions/2445009/attachments/1422530/2180614/WIT2017.pdf). In this example, the top layer (shown) and bottom layer (not shown) is thick, while the inner layers (shown) are thin. The thin layers may deform under shock and vibration or may exhibit failure due to repeated flexing from applied voltages. Additionally, these thin membranes are susceptible to breakage and/or electrical failure.

FIG. 2 shows another example of an image intensifier. This device, which comprises a thick silicon layer with channels, is considerably complex and difficult to manufacture. In this structure, bonded regions surrounding active areas provide robustness. However, this design has the disadvantage of signal loss in the bonded regions (see, https://www.osti.gov/servlets/purl/1476363). Electrons emitted from the photocathode have radial energy (not just tangential energy) so if the channels are too long, the electrons will impact the sides before reaching the next receiving surface.

Increasing the thickness of the gain layer to add support or adding other specialized features to the gain layer generally leads to signal degradation and may increase manufacturing complexity. Thus, there is a tradeoff between the thickness of the gain layer and the ability of the carriers to pass through the gain layer without signal loss or degradation of the carriers.

SUMMARY

According to an embodiment, an electron multiplier for a Micro-Electro-Mechanical-Systems (MEMS) image intensifier includes a photocathode, a transmission or gain substrate layer, and a phosphor or sensing layer (also referred to as an anode). The photocathode layer comprises an input surface that receives electrons and an emission surface (opposite the input surface) that emits electrons into a vacuum or gap. The emitted electrons pass through the vacuum to an input surface of the gain substrate layer. The received electrons are amplified by the gain substrate layer, and are emitted into a vacuum at an emission surface (opposite the input surface) of the gain substrate layer. A first plurality of support ribs are present on the input surface of the gain substrate layer, and a second plurality of support ribs are present on the emission surface of the gain substrate layer, adding mechanical support to the thin gain substrate layer while minimizing signal degradation and loss.

In some aspects, the height of the first plurality of ribs and the height of the second plurality of ribs are about the same. In other aspects, the height of the first plurality of ribs is less than the height of the second plurality of ribs. In still other aspects, the height of the first plurality of ribs is greater than the height of the second plurality of ribs.

According to another embodiment, the height of the first plurality of ribs and the height of the second plurality of ribs are each set to provide a predetermined degree of mechanical rigidity to the gain substrate layer.

In other aspects, the spacing between the individual ribs of the first plurality of ribs are configured to allow electrons emitted from the photocathode to be received on the input surface of the gain substrate layer without substantial degradation from contacting the walls of the first plurality of ribs. The spacing is determined at least in part by the distance between the emission surface of the photocathode and the input surface of the gain substrate layer (gap distance). Similarly, the spacing between the individual ribs of the second plurality of ribs are configured to allow electrons to be emitted from the emission surface of the gain substrate layer without substantial degradation from contacting the walls of the second plurality of ribs. The radial spread of electrons may be determined by the following equation:

$$r = 2 * \text{gap} * \sqrt{\left(\frac{MTE}{V_{bias}}\right)} \qquad \text{Eq. (1)}$$

wherein the gap is the distance between surfaces (e.g., between the emission surface of the photocathode and the input surface of the gain substrate layer), MTE is the mean transverse energy of the emitted electrons, and Vbias is the bias between the two surfaces.

In general, the individual ribs of the first plurality of ribs are aligned with respective individual ribs from the second plurality of ribs. For example, each individual rib of the first plurality of ribs may be positioned such that a vertical axis passes through a rib of the first surface, through the gain substrate layer and through a corresponding rib of the second plurality of ribs.

In another aspect, blocking structures/regions can be used in a transmission mode image intensifier to maintain the spatial registration of carriers in the gain substrate layer. Ribs, on both the upper input surface and lower emission surface, may be used to increase the robustness of the thin silicon-based gain substrate layer.

BRIEF DESCRIPTION OF THE DRAWINGS

Like reference numerals have been used to identify like elements throughout this disclosure.

DETAILED DESCRIPTION

A gain substrate layer for a MEMS image intensifier is presented herein. The gain substrate layer includes a first plurality of ribs on an upper input surface and a second plurality of ribs on a lower emission surface. In some aspects, each of the upper ribs is aligned with a corresponding lower rib.

The gain substrate layer presented herein includes p-type doped ribs on both the upper input surface and the lower emission surface. The ribs define a plurality of cells, or pixels, insofar as the term "doped" or variants thereof (e.g., referred to herein as doping, dopant, etc.) indicates that a dopant has been added to shift the Fermi levels within the silicon-based material, such that with p-type dopants, the ribs are shifted to predominantly positive charge carriers. Advantageously, since the ribs comprise a p-type doped material, the ribs prevent electron crosstalk between pixels. According to an embodiment, the ribs extend above an input surface of the gain substrate layer (e.g., electron multiplier) and below the output emission surface of the gain substrate layer. Further, halo effects created by backscattered electrons are minimized by the ribs, only on the input surface 312*a*.

By extending lateral spacers perpendicular to or substantially perpendicular to the input surface and emission surface of the gain substrate layer, height may be added to the thin gain substrate layer, as a grid type, post type, or other suitable structure, to provide mechanical support while maintaining signal integrity. Thus, an enhanced thin gain substrate layer (also referred to as an electron multiplier layer or a transmission layer), which is ideal for maintaining spatial registration of carriers (e.g., holes) in the electron multiplier layer, can be generated by modifying a thin gain substrate layer to include a first plurality of upper ribs and a second plurality of lower ribs in order to be mechanically robust over large areas while maintaining signal integrity.

Typically, ribs that extend above the input surface of the gain substrate layer cause at least some electrons to be lost between the cathode layer and the gain substrate layer (e.g., electrons that impact a surface of a rib may be lost). This effect may be minimized by reducing a first gap distance between the gain substrate layer and the photocathode layer, as well as by controlling the spacing of the ribs, or by varying the voltage according to Eq. (1).

The image intensifier provided herein is intended to be an example. The electron multiplier can be included in any MEMS image intensifier or light detection device now known or developed hereafter.

Figure 1:
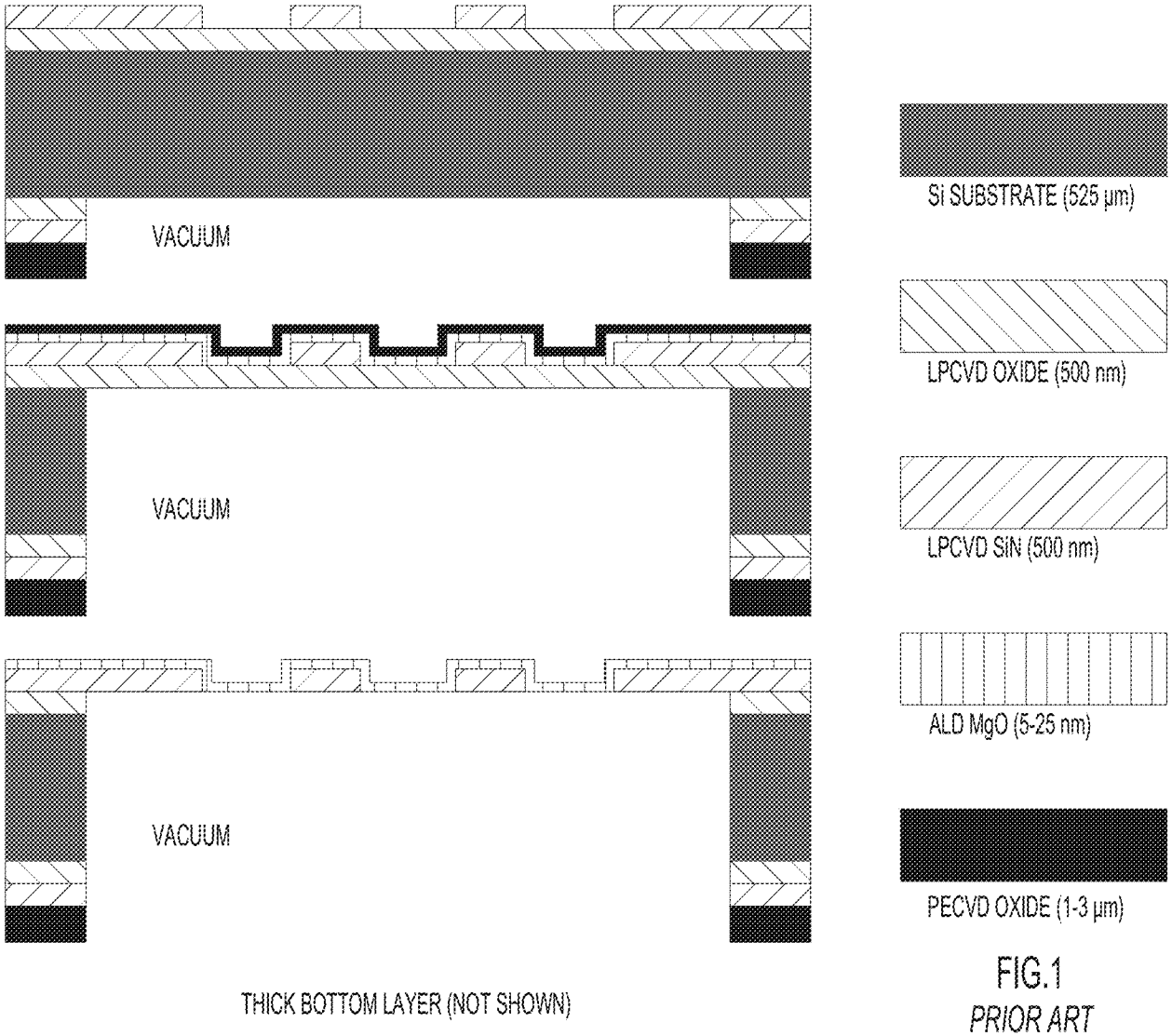
FIG. 1 PRIOR ART
FIG. 1 is an illustration of an image intensifier, according to the prior art.
Figure 2:
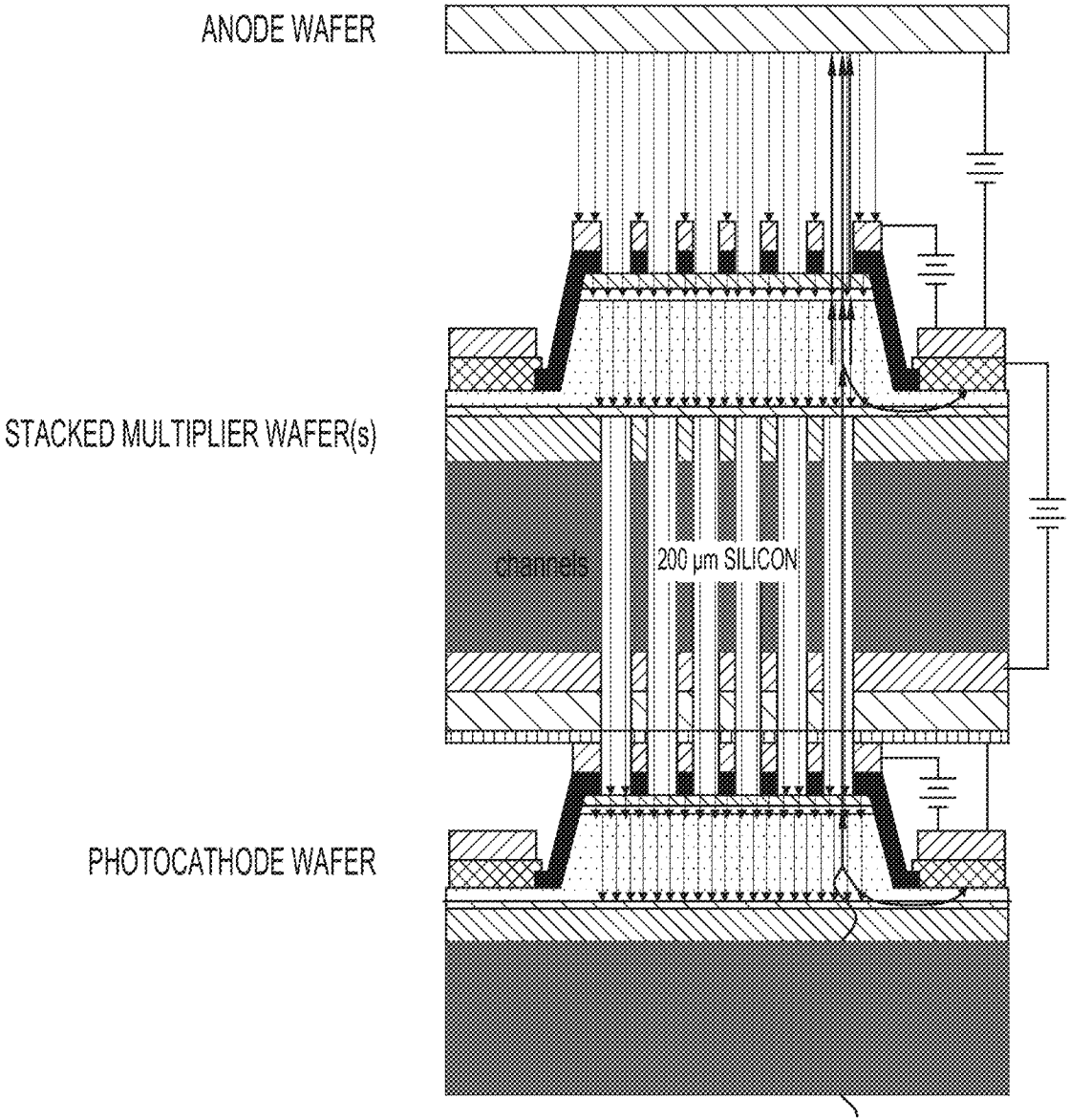
FIG.2 PRIOR ART
FIG. 2 is an illustration of another image intensifier, according to the prior art.
Figure 3:
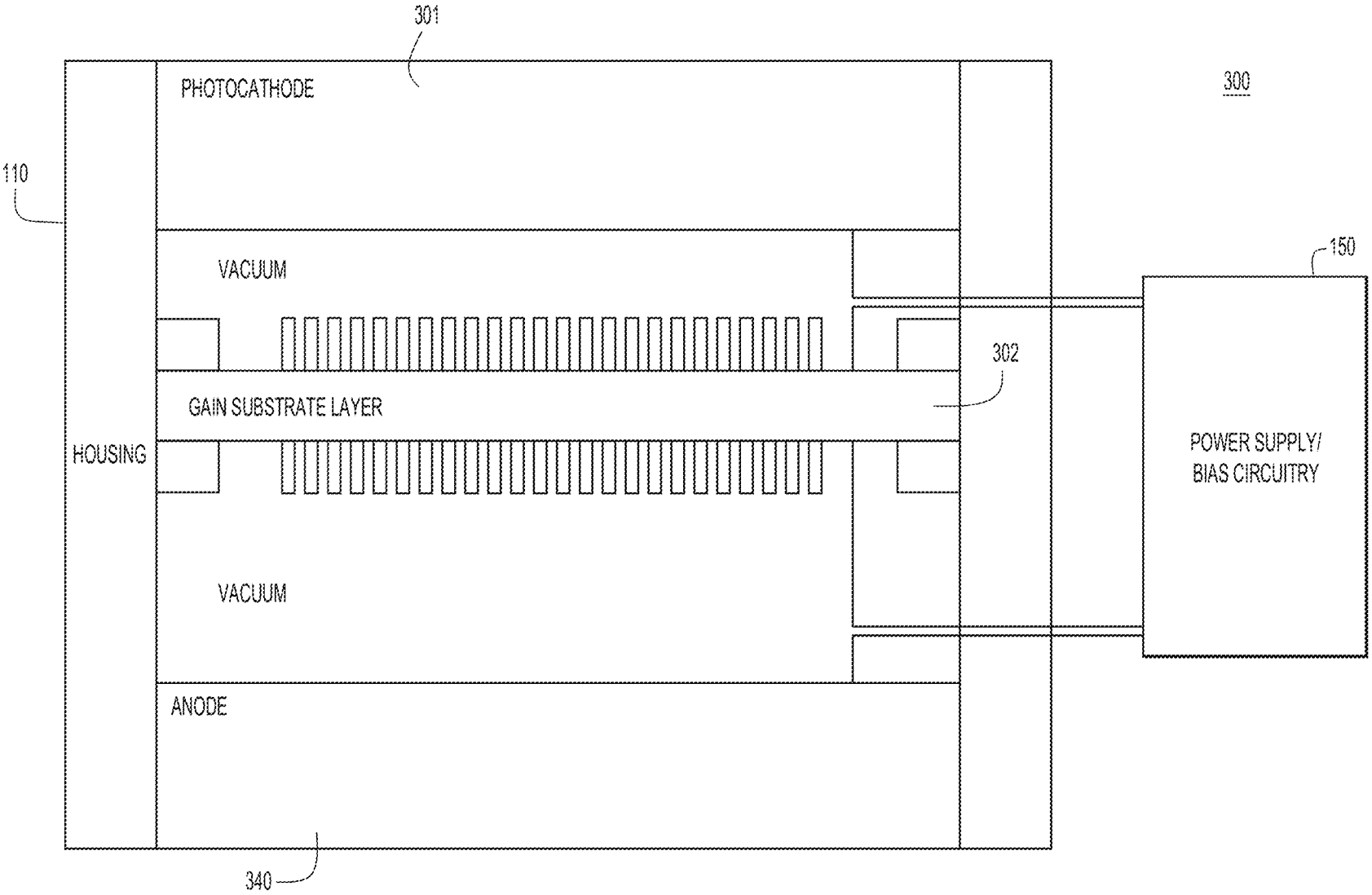
FIG. 3 shows a high-level cross-sectional view of a MEMS image intensifier, in accordance with an example embodiment.

FIG. 3 shows a high level cross-sectional view of a MEMS image intensifier 300 according to an embodiment. The MEMS image intensifier comprises a photocathode 301, a gain substrate layer 302, and anode 340. A vacuum (first gap) separates the photocathode from the gain substrate layer. A vacuum (second gap) also separates the gain substrate layer from an anode. The vacuum layer allows the signal to be maintained, rather than undergo degradation from passing through another layer of a material.

The layers are encapsulated in an appropriate vacuum housing 110, and may be connected to an external power supply comprising bias circuitry 150 to bias the physical layers of the device to suitable voltages. More specifically, the bias circuitry 150 may include one or more circuits to appropriately bias photocathode 301, gain substrate layer 302, and anode 340 of the MEMS image intensifier 300. The MEMS image intensifier is described in further detail below.

Figure 4:
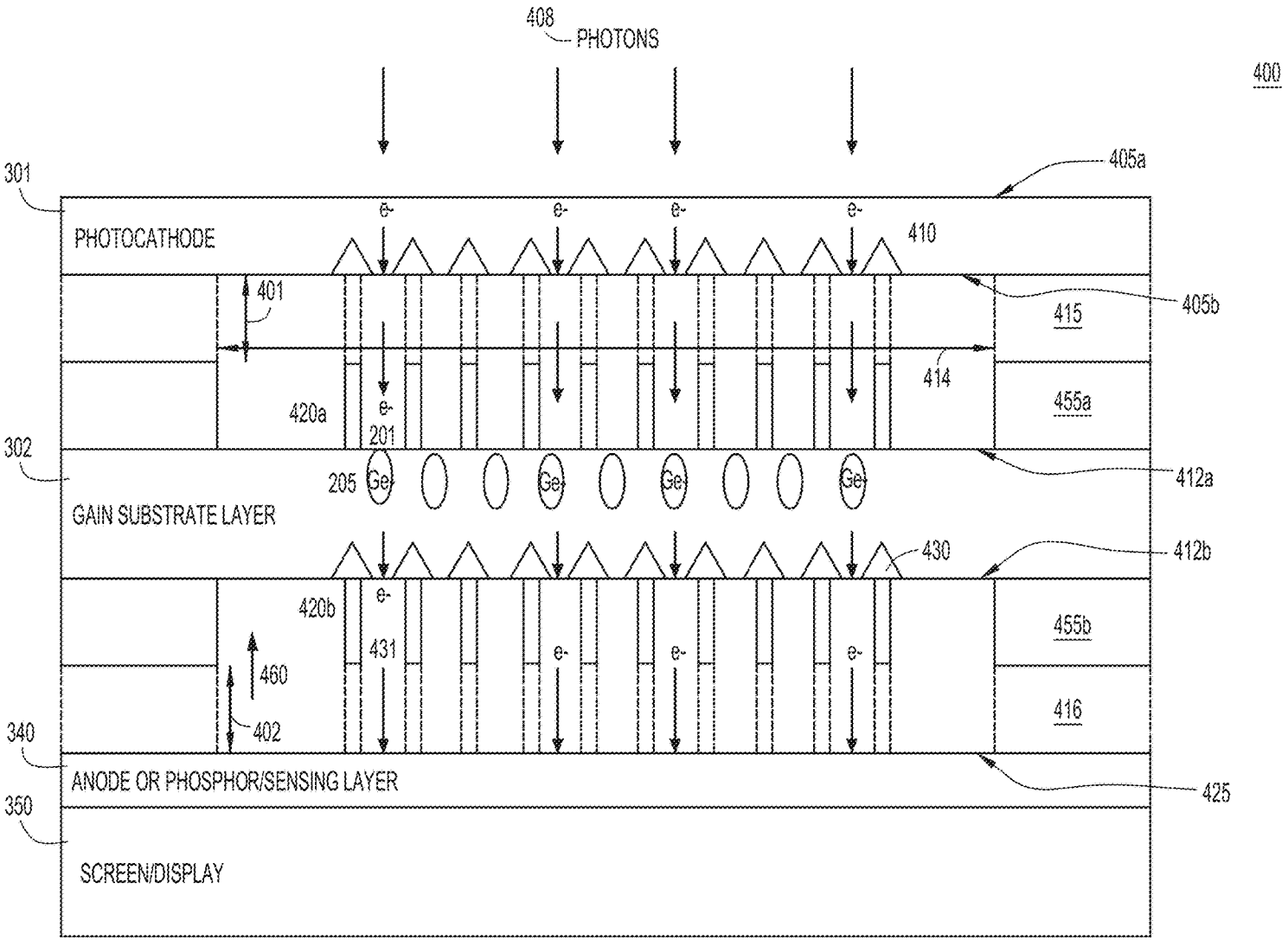
FIG. 4 is a cross-sectional view of a MEMS image intensifier including a gain substrate layer configured in accordance with an example embodiment.

FIG. 4 shows a cross-sectional view of MEMS image intensifier 400, with a gain substrate layer configured to multiply electrons in accordance with example embodiments as provided herein. MEMS image intensifier 400 includes photocathode 301, a gain substrate layer 302, and a phosphor/sensing layer 340 (also referred to as an anode layer). The phosphor/sensing layer may be coupled to a screen/display 350, allowing a user to visualize the output of the gain substrate layer. In some aspects, a first vacuum or first gap distance 401 is present between the photocathode 301 and the gain substrate layer 302. A second vacuum or second gap distance 402 is present between the phosphor/sensing layer 340 and the gain substrate layer 302. Region 455*a* corresponds to the height of ribs 420*a*, while region 455*b* corresponds to the height of ribs 420*b*.

Various fabrication processes may be used to form the ribs. To form the first plurality of ribs 420*a*, a silicon-based layer may be generated on the input surface of the gain substrate layer with a height corresponding to the height of region 455*a*. Known fabrication processes involving etching may be used to form ribs, as posts, walls, etc. After etching, ribs are present in the active region 414, with region 455*a* intact.

To form the second plurality of ribs 420*b*, polysilicon-based layers may be built up on the emission layer of the gain substrate layer, to reach a height corresponding to the height of region 455*b*. Ribs are generated in the active region 414, with region 455*b* intact. Additional details regarding fabrication of the gain substrate layer are provided herein.

Region 415 represents a first gap distance between the tip of ribs 420*a* and photocathode 301. Region 416 represents a second gap distance between the tip of ribs 420*b* and phosphor/sensing layer 340.

The photocathode 301 includes an upper surface 405*a* and an output emission surface 405*b*. Photons 408, present in regions outside of the image intensifier, may contact the photocathode 301 to convert photons to electrons. When photons 408 impinge on the upper surface 405*a* of the photocathode 301, each impinging photon 408 has an associated probability of generating a free electron. Free electrons (e−) resulting from impinging photons 408 pass through photocathode 301 and are emitted from output emission surface 405*b*. In some aspects, the output emission surface 405*b* is activated to or configured to a negative electron affinity (NEA) state, using well-known techniques, to facilitate the flow of the free electrons (e−) from the output emission surface 405*b* of the photocathode into the first gap distance 401 of the vacuum.

In some aspects, photocathode 301 is a photocathode layer comprising semiconductor materials such as gallium arsenide (GaAs), which exhibits a photoemissive effect. It is noted that other type III-V materials may be used, including but not limited to GaP, GaInAsP, InAsP, InGaAs, etc. Alternatively, the photocathode may comprise a known bi-alkali material, which includes but is not limited to antimony-rubidium-cesium (Sb—Rb—Cs), antimony-potassium-cesium (Sb—K—Cs), sodium-potassium-antimony (Na—K—Sb), etc., which also has a photoemissive effect.

In this example, the photoemissive semiconductor material of the photocathode 301 absorbs photons at the upper surface 405*a*. The absorbed photons cause the carrier density of the semiconductor material to increase, thereby causing the photo-emissive semiconductor material to generate a photo-current of electrons (as shown by the arrows) passing through photocathode 301 for emission from the output emission surface 405*b*. In some aspects, photocathode 301 comprises blocking structures 410 (shown as triangles). The blocking structures are configured to focus the electrons (e.g., into streams of emitted electrons) as the electrons leave the photocathode 301 to travel through the first gap distance 401 to reach the gain substrate layer. Thus, the photocathode 301 convert photons 408 received from ambient light to electrons (e−), and releases these electrons towards the gain substrate layer 302 in streams that are spatially co-located with the open area between ribs 420*a* in the input surface 412*a* of the gain substrate layer 302.

The gain substrate layer 302, which may also be referred to as an electron multiplier layer or transmission layer, includes an input surface 412*a* and an emission surface 412*b* that is opposite the input surface 412*a*. Photocathode 301 is positioned above the input surface 412*a*, separated by first gap distance 401, such that the photocathode 301 emits electrons towards the input surface 412*a*.

Gain substrate layer 302 may include silicon and/or other semi-conductive materials such as, and without limitation, gallium arsenide (GaAs). In an embodiment, gain substrate layer includes silicon-based component(s) and is doped with a p-type dopant to generate a plurality of electrons 205 for each free electron 201 that impinges on an input surface 412*a* of the gain substrate layer.

An electric field (not shown) between the photocathode 301 and the gain substrate layer 302 accelerates the electrons emitted by the photocathode towards the gain substrate layer, causing the electrons to impact the input surface 412*a* of the gain substrate layer 302. The gain substrate layer 302 amplifies the received electrons forming electrons 205 and emits additional electrons (designated as Ge− and referred to as an electron interaction volume), via emission surface 412*b*, towards the phosphor/sensing layer 340. Thus, there is a gain of electrons through the gain substrate layer 302.

The gain substrate layer 302 provides a highly efficient gain, which allows the MEMS image intensifier 400 (more specifically, the phosphor/sensing layer 340 and screen/display 350) to output visible light that a user can view in a direct view system (e.g., a system where a user looks directly at screen/display 350 for an image) or in a digital system (e.g., a system where a user views a digital output from a camera focused on a phosphor screen).

The gain substrate layer 302, which may be formed using a wafer or other suitable substrate (e.g., a silicon-based substrate), comprises an active region 414 that is configured to receive and amplify electrons emitted by the photocathode 301. The active region 414 includes a lattice or grid of interior walls or posts, referred to as a first plurality of ribs 420*a*, positioned on the input surface 412*a* and formed, for example, using single crystal silicon processes such as etching (a subtractive process), or another suitable process.

Another lattice or grid of interior walls or posts, referred to as a second plurality of ribs 420*b*, positioned on the emission surface 412*b* and formed, for example, using polysilicon crystal or boron doped polysilicon processes (additive processes), or another suitable process. In some aspects, to create the second plurality of ribs 420*b*, doping profiles may be generated by trenching, and polysilicon deposition may be used to form layer(s). In some aspects, processes such as Lithography, Electroplating, and Molding (LIGA) or other processes may be used to build up polysilicon layers. In some aspects, a thick photoresist applied to emission surface 412*b* may be used to build up polysilicon layers to form the plurality of second ribs, also using an additive process.

Figure 5:
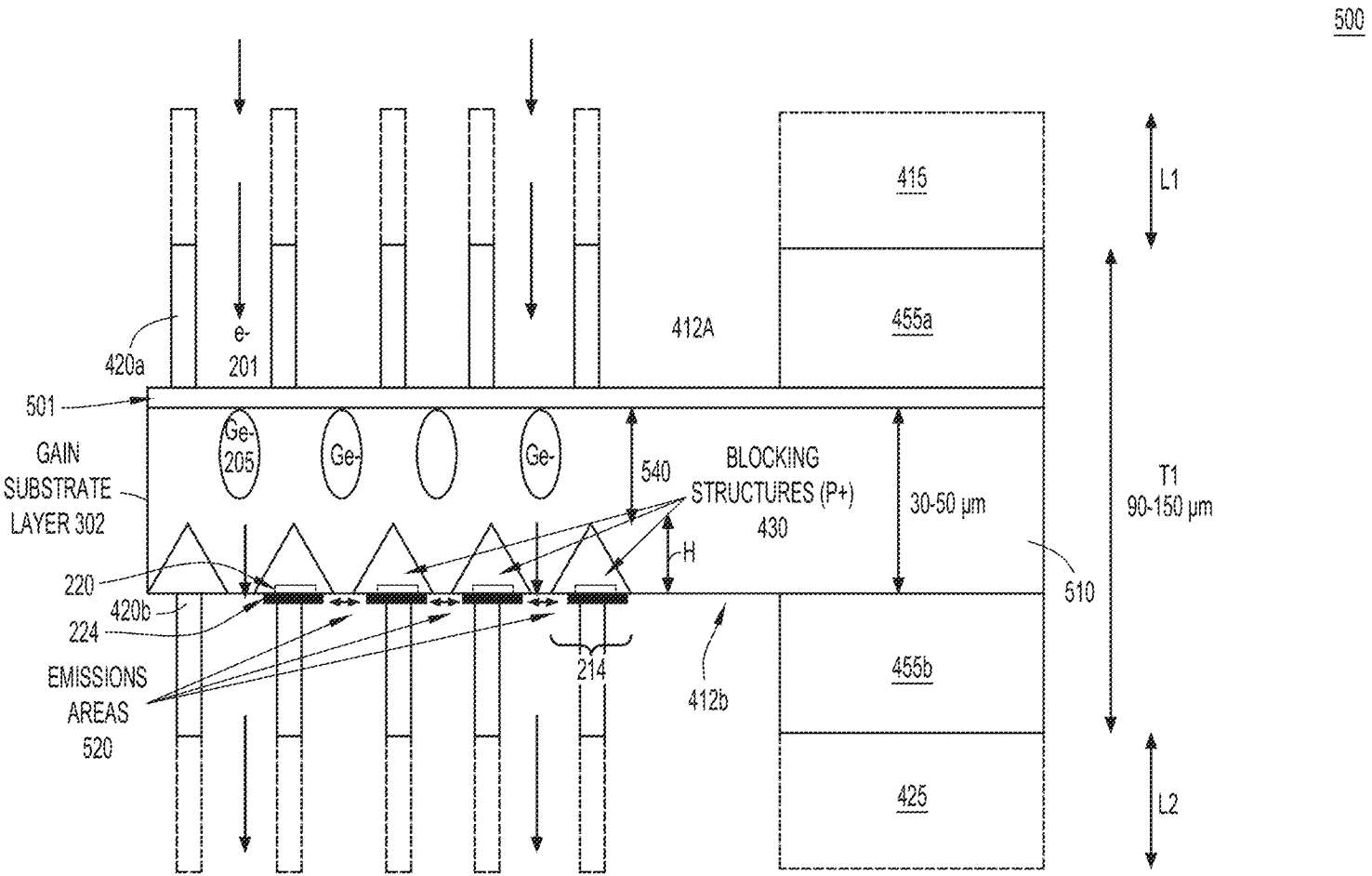
FIG. 5 is an enlarged cross-sectional view of the gain substrate layer of FIG. 4, showing additional aspects of an example embodiment.
Figure 6:
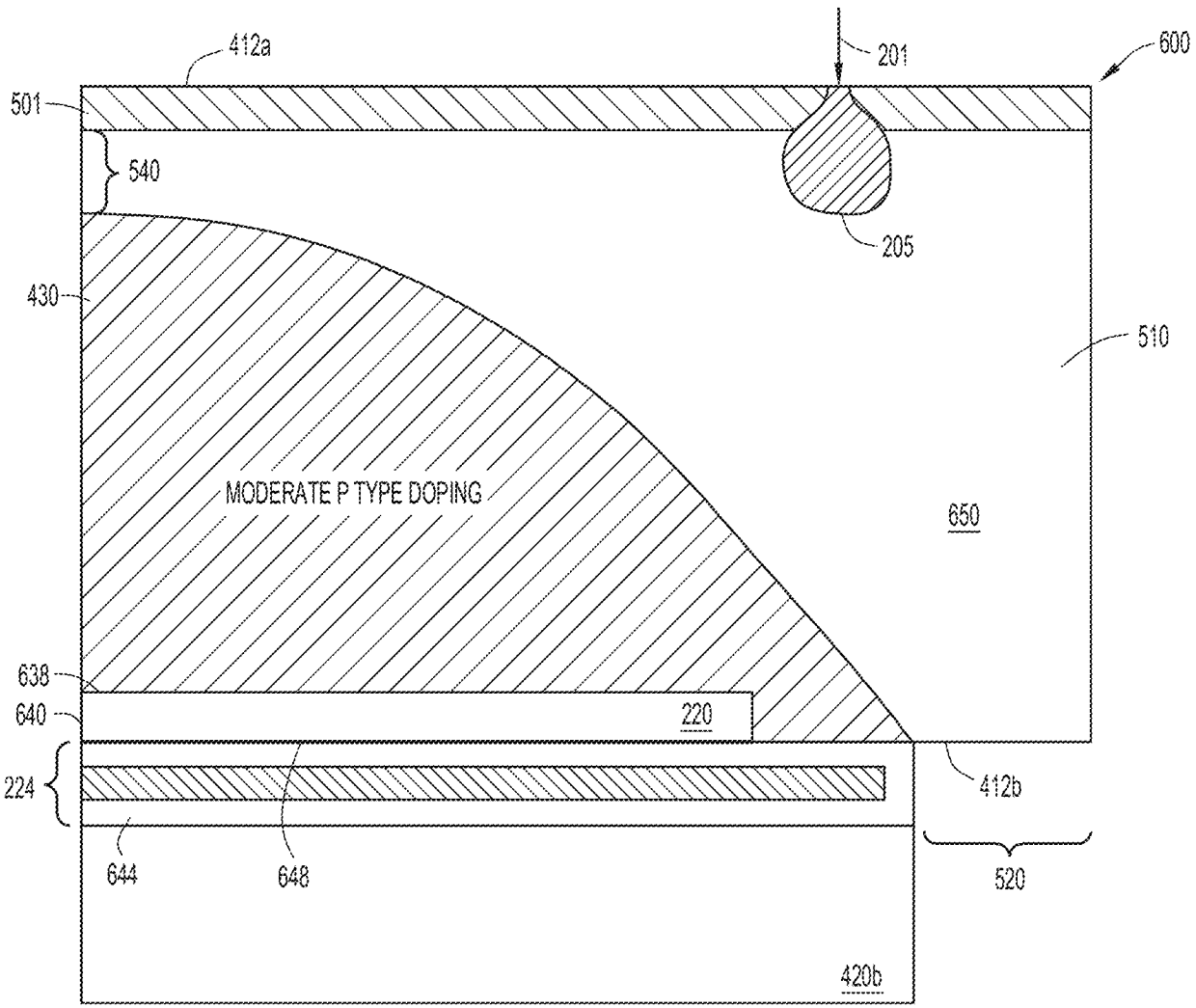
FIG. 6 is an enlarged cross-sectional view of a blocking structure of the MEMS image intensifier of FIGS. 4 and 5, according to an example embodiment.

Ribs 420*a* or 420*b* may be formed on the input surface 412*a* or emission surface 412*b*, respectfully, using any suitable fabrication technique that generates a lattice or grid of walls or posts. Blocking structures 430 may be formed along the emission surface 412*b*, in order to focus the flow of emitted electrons to the anode 340. Since the blocking structures are formed from a doped material (e.g., a p-doped material), the blocking structures prevent, or at least discourage, electrons from moving laterally within the gain substrate layer 302, because the doped material produces an electrostatic barrier (i.e. an electric field that repels negative charged carriers). The barriers or blocking structures 430 are described in further detail below (FIGS. 5 and 6).

The MEMS image intensifier 400 may be configured to optimize individual electron paths through the various layers of the device. For example, individual components of the blocking structures 410, ribs 420*a*, blocking structures 430, and ribs 420*b* may be aligned such that an electron is directed along a vertical axis through these various layers and gaps, to prevent signal degradation from electrons moving horizontally. Thus, an electron stream may originate in the photocathode layer, pass through the vacuum and in between ribs 420*a* to enter the gain substrate layer, and pass through the gain substrate layer between blocking structures 430, to exit between ribs 420*b* to reach the anode layer. Accordingly, the path may follow or track along a vertical axis to focus the emission of electrons in streams towards the phosphor/sensing layer 340. In other aspects, the first and second plurality of ribs 420*a*, 420*b*, and blocking structures 430 may be aligned in order to maximize signal gain. By aligning the ribs, and blocking structure 430, the flow of electrons is directed and signal gain is optimized through the gain substrate layer. In other aspects, the gain substrate layer may provide suitable electron multiplication without blocking structures 430; however, the first plurality of ribs 420*a* and the lower ribs 420*b* are aligned.

Thus, in some aspects, the first and second plurality of ribs 420*a*, 420*b*, are aligned to form a plurality of pixels, such that the regions between ribs correspond to a pixel. Areas or pixels on the upper input surface and lower emission surface are aligned as a result. Electrons entering the gain substrate layer are amplified during passage along a vertical axis, wherein the electrons enter a region corresponding to a first input pixel on the upper input surface and exit a region of a corresponding first output pixel on the lower emission surface (as shown by arrows in FIGS. 4 and 5).

In some aspects, ribs 420*a* are made of p-type doped material and are in contact with or extend, at least slightly, into the input surface 412*a* of the gain substrate layer 302. Similarly, ribs 420*b* are made of p-type doped material and are in contact with or extend, at least slightly, into the emission surface 412*b* of the gain substrate layer 302. The first plurality of ribs 420*a* is perpendicular or substantially perpendicular to the input surface 412*a*, and the second plurality of ribs 420*b* is perpendicular or substantially perpendicular to the emission surface 412*b*, respectfully.

The phosphor/sensing layer 340 is positioned below the emission surface 412*b* of the gain substrate layer 302, such that the phosphor/sensing layer 340 may receive electrons emitted from the emission surface 412*b*. A small amount of stray particles 460 (e.g., photons, ions, etc.) may undergo backscattering, leading to signal degradation and loss. The backscattered electrons may contact the second plurality of ribs 420*b* and/or emission surface 412*b* of the gain substrate layer 302. Stray particles 460 that impinge on emission surface 412*b* may convert to stray electrons and corresponding stray holes. Thereafter, the free electrons may be emitted from emission surface 412*b* to contact the phosphor layer (see also, FIG. 5). This may negatively impact recording and/or presentation of an image (e.g., as noise).

In an embodiment, anode 340 may include a phosphor screen to convert the amplified electrons (e−) 431 to photons. The input surface 425 of the phosphor/sensing layer 340 may be coated with a conducting material (not shown), such as chrome or some other suitable metal, to provide an electrical contact layer to receive the emitted electrons from emission surface 412*b*.

In another embodiment, anode 340 may comprise a conventional integrated circuit with a CMOS substrate and a plurality of collection wells, commonly used in image intensifier tubes. The electrons may be processed using signal processing equipment for CMOS sensors to produce an intensified image signal for display to the user.

FIG. 5 is a cross-sectional view of a portion of a semiconductor structure 500 corresponding to gain substrate layer 302, for example, the gain substrate layer of FIG. 4. Gain substrate layer 302 is doped to generate a plurality of electrons 205 for each free electron (e−) 201 that impinges on the input surface 412*a* of the gain substrate layer. In some cases, germanium may be added to the gain substrate layer 302.

In some aspects, the thickness of the gain substrate layer may be about 30-50 μm, and the thickness of the gain substrate layer including both sets of ribs (T1) may be, without limitation, approximately 90-150 μm, wherein the first plurality of ribs 420*a* and the lower ribs 420*b* are included in the thickness. In some aspects, the thickness of the ribs may be about the same thickness as the gain substrate layer. Regions 415 and 416 correspond to vacuum or gap regions.

Gap distance (L1) is measured from the photocathode layer to the tip of ribs 420*a* and typically has a distance of about 100-500 μm. In some embodiments, the gap distance is about 254 μm. Gap distance (L2), the distance between the phosphor layer and the tip of the rib 420*b*, is in the range of about 250-385 μm. The height of ribs 420*a* does not need to be same as the height of ribs 420*b*. However, a rib from 420*a* is in vertical alignment with a rib from 420*b*, in order to minimize signal loss.

In an embodiment, the gain substrate layer may include first region 501 and second region 510, which are configured (e.g., via doping) to direct the flow of electrons 205 to emission areas 520 of emission surface 412*b*. Emission areas 520 may be activated to a NEA state to facilitate electron flow from emission surface 412*b*.

The first region 501, which is disposed adjacent to input surface 412*a*, may be doped to force electrons away from input surface 412*a* and into gain substrate layer 302, thus inhibiting recombination of electron-hole pairs at input surface 412*a*. Inhibiting recombination of electron-hole pairs at input surface 412*a* ensures that more electrons flow through gain substrate layer 302 to emission surface 412*b*, thereby increasing efficiency. The first region 501 may be doped with a p-type dopant such as boron or aluminum, and may be relatively heavily doped (e.g., about $10^{19}$ parts per cubic centimeter), approximately 100-300 nm deep. Other suitable dopants, concentrations, and dimensions for use with silicon semiconductors and other semiconductor materials, e.g., GaAs, will be readily apparent to those skilled in the art of semiconductor fabrication. In some aspects, the input surface 412*a* of the gain substrate layer 302 is coated with a conducting material (not shown), such as chrome, adjacent to the first region 501 to provide an electrical contact to the upper surface of the gain substrate layer 302.

The second region 510 may be a moderately p-doped material, and may also be referred to herein as a background region. The second region may also comprise blocking structures 430 that are relatively heavily doped (e.g., $10^{19}$ parts per cubic centimeter), e.g., with a p-type dopant such as boron or aluminum. The second region 510 (alone and/or in combination with first region 501), may be referred to as an electron multiplier region.

Blocking structures 430, disposed on the emission surface 412*b*, are doped (e.g., using P+ dopants) to repel electrons 205 to emission areas. Blocking structures 430 define blocking areas 214 of emission surface 412*b*, where electron flow into and out of gain substrate layer 302 is inhibited. Blocking areas 214 are regions at emission surface 412*b* that are effectively blocked by one or more of blocking structure 430, shield 220 and dielectric film 224. Blocking structures 430 may also help to maintain spatial fidelity, for example, by directing stray electrons (moving laterally) into the appropriate emission area 520, helping to ensure that electrons 205 enter and exit gain substrate layer 302 along a vertical trajectory and do not cross into adjacent emission areas. Blocking structures 430 may have a height H of approximately 24 μm. The emission areas 520 may have a diameter of about 1 μm, with a 6 μm pitch between blocking structures 430.

The blocking structures focus electrons to small areas, emission areas 520, for emission. Additionally, focusing allows the electrons to travel greater distances. By funneling the electrons, the frequency of electrons that contact sidewalls of ribs is greatly reduced. This facilitates flow of the electrons to the phosphor layer without or with minimal signal loss.

Gain substrate layer 302 may further include shields 220, which are doped to reduce and/or minimize effects of stray particles 460 (see, FIG. 4). Shield 220 may be doped with an N-type dopant, e.g., by diffusion or implantation. In an embodiment, shield 220 is doped to encourage recombination of free electrons and free holes, thus, absorbing stray particles 460. In some aspects, shield 220 may be disposed within gain substrate layer 302, positioned at the base of the blocking structure 430, proximal to the emission surface 412*b*. In some aspects, shields may be optional.

In other aspects, gain substrate layer may further include a dielectric film 224 disposed on emission surface 412*b*, positioned atop the base of the blocking structures 430. A first surface of the dielectric film 224 may contact one end of ribs 420*b* and a second surface of the dielectric film may contact a surface of shield 220 at the emission surface 412*b*. In some aspects, dielectric film 224 may be optional.

Thus, shield 220 is disposed within a blocking structure 430, wherein the surface of shield 220 is disposed at the emission surface 412*b* and the dielectric film 224 is disposed atop the emission surface 412*b*. Ribs 420*b* are disposed atop dielectric film 224.

As mentioned previously, the distance between the photocathode and the tip of the ribs 420*a* may be reduced, allowing a lower voltage to be used. By decreasing this distance, a more compact and mechanically robust transmission mode image intensifier structure is provided allowing operation at lower voltages. Reduction of voltage and reduced rib spacings allow common wafer level fabrication processes to be used to make the image intensifier, and may lead to a reduction in the number of substrates.

Typically, the voltage will be set at a value suitable for extracting electrons from the photocathode and will provide enough energy to overcome the dead voltage of the gain layer to provide the desired gain. However, the voltage will be lower than a value which may lead to the generation of X-rays by the bombarding electrons. Thus, in some aspects, the upper limit is about 2000V and the lower limit is about 600V. The values may also depend upon the spacing between the tip of the ribs and the photocathode 301 (gap distance 401).

Gap 540 may be provided between first region 501 and blocking structures 430. Gap 540 may be sized or dimensioned such that the blocking structures do not interfere with the generation of electrons 205 at input surface 212*a*. This may provide the gain substrate layer with an effective electron multiplication area that equals or approaches 100% of an area of input surface 212*a*. Gap 540 may be, without limitation, approximately 1 μm to 49 μm or any other suitable distance in between. Other suitable dopants, concentrations, dimensions, and/or semiconductor materials, such as GaAs, may be used, as will be readily apparent to one skilled in the relevant art(s). The gain substrate layer 302 may generate several hundred electrons or more for each received electron. Accordingly, the number of electrons exiting the gain substrate layer 302 is significantly greater than the number of electrons that entered the gain substrate layer.

Still referring to FIG. 5, regions between adjacent blocking structures 430 may form channels (see, FIG. 6, channel 650) that extend from input surface 212*a* to emission areas 520 of the emission layer 212*b*. The channels have relatively wide cross-sectional areas near input surface 212*a*, and relatively narrow cross-sectional areas towards emission areas 520. The channels may act as funnels to direct electrons 205 to emission areas 520, and are bounded by the blocking structures 430. The channels may also be referred to herein as electron bombarded cells (EBCs). Semiconductor structure 500 may be configured with an array of EBCs, such as described below with reference to FIGS. 6-8. Semiconductor structure 500 is not, however, limited to the examples of any of FIGS. 6-8.

FIG. 6 shows an illustration of semiconductor structure 600, which includes dielectric film 224, including a first oxide layer 638 disposed on the emission surface 412*b* of a metal layer 640, e.g., aluminum, disposed on the first oxide layer 638, and a second oxide layer 644 disposed on the metal layer 640. Shield 220 is shown, adjacent to emission surface 412*b* and within the blocking structure 430. In some aspects, shield 220 is optional. In other aspects, dielectric film 224 is optional, and ribs 420*b* may be disposed at emission surface 412*b*, in contact with blocking structure 430 and or shield 220.

In an exemplary embodiment, the layers of dielectric film 224 are fabricated using conventional fabrication techniques that are readily apparent to those of skill in the art. In one exemplary embodiment, the first oxide layer 638 is approximately 100-300 nanometers thick, the metal layer 640 is approximately 100-300 nanometers thick, and the second oxide layer 644 is approximately 100-300 nanometers thick. In accordance with this embodiment, the total thickness of dielectric film 224 is approximately 300-900 nanometers.

The layers of the illustrated dielectric film 224 perform a variety of functions in the exemplary embodiment. The first oxide layer 638 prohibits the emission of electrons from the emission surface 412*b* of the semiconductor structure 600 in areas where it is deposited (the blocked area 648) thereby reducing any "dark current" by the ratio of area blocked by the first oxide layer 638 to the total area of the emission surface 412*b*. Dark current is the flow of electrons within a semiconductor structure produced by thermal variations, which creates random generation of electrons and holes, or noise, in the EBC.

In an exemplary embodiment, the metal layer 640 is biased to draw the increased number of electrons 205 toward it through the gain substrate layer. In the exemplary embodiment, the biasing is low, e.g., less than one volt, to prevent electrons from gaining enough energy to penetrate blocking structure 430 and to prevent damage to the gain substrate layer. In addition, the metal layer 640 acts as a blocking layer for light feedback in embodiments where a photoemitter or phosphor screen is used as a phosphor/sensing layer 340 (FIG. 4). The metal layer 640 absorbs/reflects photons originating from such devices to prevent the photons from reaching the photocathode 301 through the emission surface 412*b*, thus reducing noise from light feedback from the phosphor/sensing layer 340.

The second oxide layer 644 is disposed on the metal layer 640 to inhibit the emission of electrons by the metal layer 640. Thus, noise attributable to the metal layer 640 is reduced. An individual rib of the plurality of ribs 420*b* is disposed on the second oxide layer 644. The width of the rib may be less than, equal to, or greater than the width of the dielectric film 224.

The illustrated emission areas 520 are geometric shapes (e.g., circles, squares, etc.) defined by the blocking structure 430. The emission areas 520 may be essentially any suitable geometric shape. In an exemplary embodiment, the blocking structure 430 extends for about 10-20 μm between emission areas 520 and the emission areas 520 are about 0.5-6.0 μm in diameter.

Figure 7A:
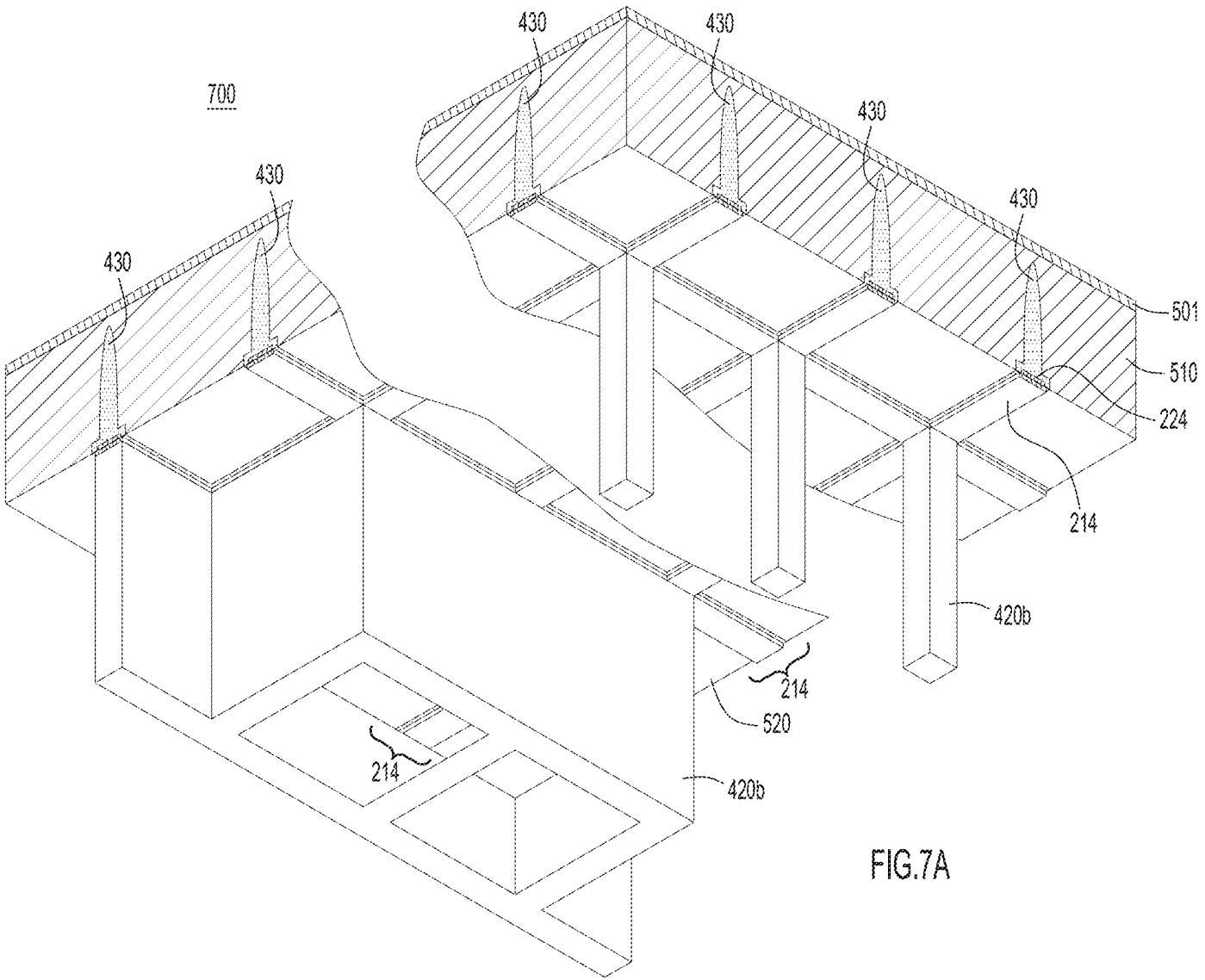
FIG. 7A is a grid-like structure showing a plurality of different types of ribs of the MEMS image intensifier, according to an example embodiment.

FIG. 7A is a cross-sectional perspective view of semiconductor structure 700, in which multiple rows of parallel and perpendicular blocking structures 430, and associated ribs 420*b* form an array of emission areas 520. Ribs are also present on the input surface 412*a* but are not shown. The ribs may be in a wall-type configuration (left) or as posts (right).

The individual EBCs form a matrix on semiconductor structure 700. Each of the EBCs, and their associated emission areas 520, correspond to regions of the input surface 412*a* such that the matrix of EBCs pixelate the electrons received at the input surface 412*a* of the gain substrate layer 302. The number of EBCs actually employed in an array may be many more or less depending on the size of the individual EBCs and the desired resolution of the image intensifier.

Figure 7B:
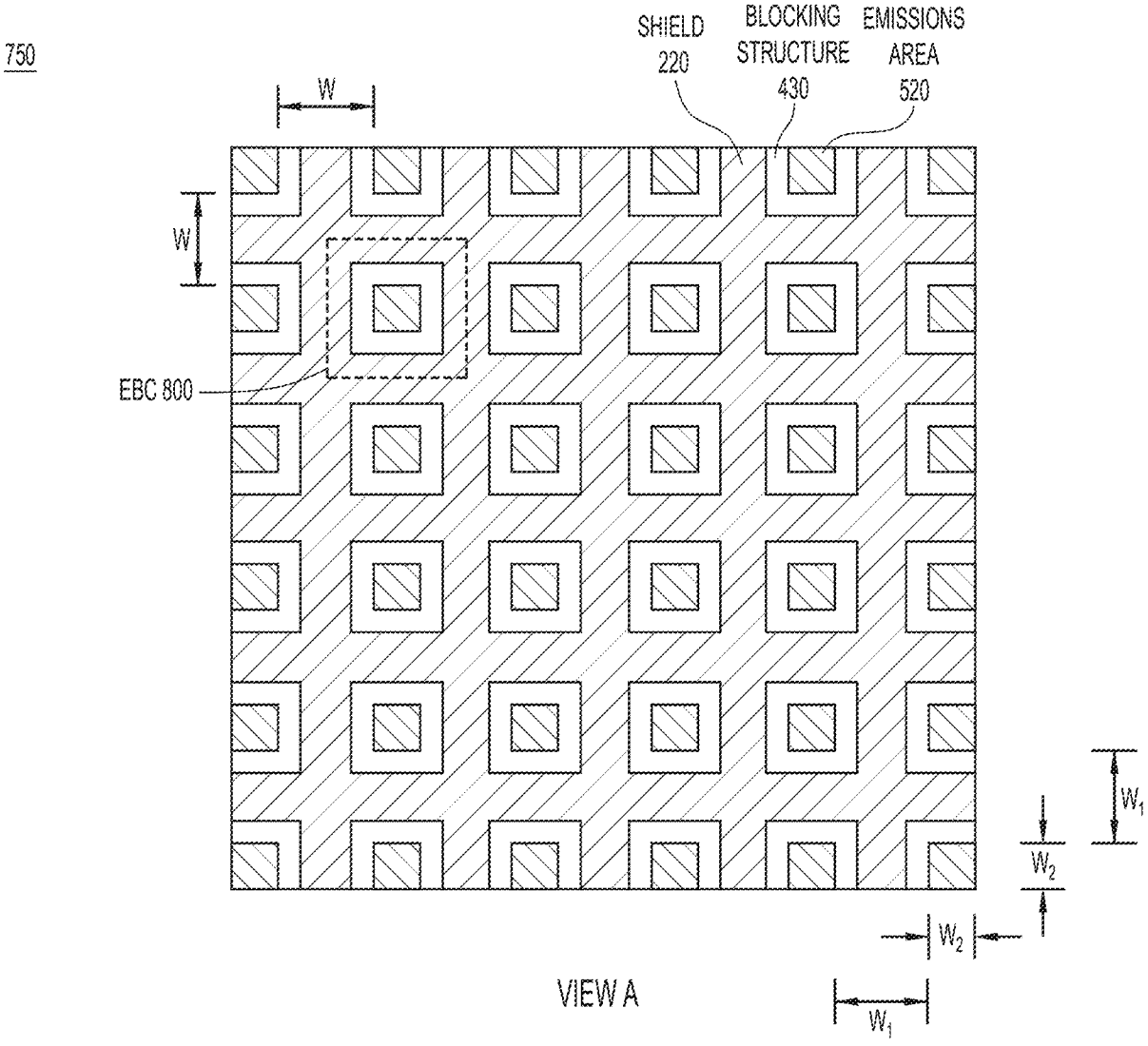
FIG. 7B is a grid-like structure showing blocking structures and shields of a MEMS image intensifier, according to an example embodiment.

FIG. 7B is another view of the example embodiment of FIG. 4, in which shield 220 is illustrated. Ribs 420*b* are not shown, but are disposed as shown in FIG. 7A. In an embodiment, a width W1 of a base portion of blocking structures 430 is approximately 10-20 μm, and a width W2 of emission areas 520 is approximately 0.5 to 2.0 μm. In this example, the area excluding emission area 520 encompass more than 80% of the emission surface 412*b* of semiconductor structure 750. Semiconductor structure 750 is not, however, limited to these examples.

Figure 8:
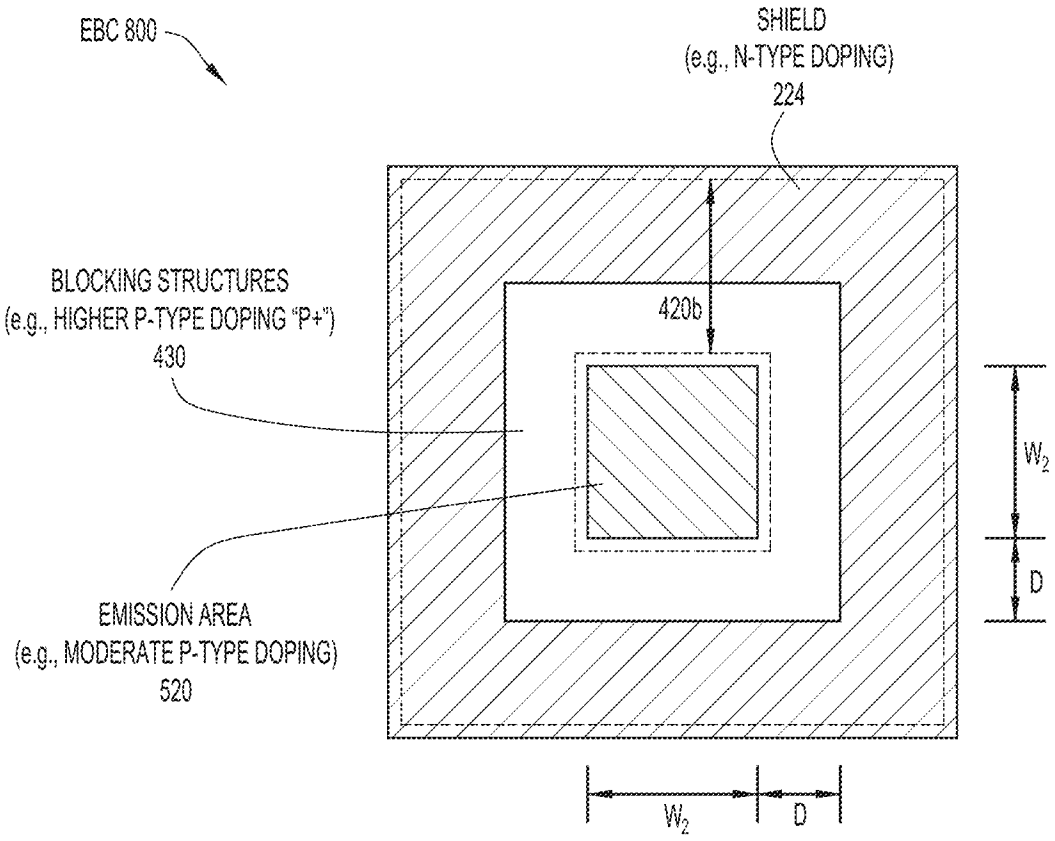
FIG. 8 is an illustration of various doping regions of the gain substrate layer and support rib, according to an example embodiment.

FIG. 8 depicts an expanded view of an EBC 800, as shown in FIG. 7B. In an embodiment, emission area 510 has a width $W_2$ of approximately 1 μm. An exposed portion (e.g., ring) of blocking structure 430 extends a distance D of approximately 0.5 μm beyond emission area 510. A rib 420*b* is disposed on the non-emission areas, and may have any suitable diameter between the inner dashed line and the outer dashed line.

In the examples of FIGS. 4-8, the gain substrate layer 302 is illustrated as a square array of EBCs. Gain substrate layer 302 may be configured with other geometric (e.g., circular, rectangular, or other polygonal shape), which may depend upon an application (e.g., circular for lens compatibility, or square/rectangular for integrated circuit compatibility). In an embodiment, to replicate a conventional micro-channel plate used in an image intensifier tube, a square array of 1000×3000 EBCs, or more, may be used. This may be useful, for example, to replicate a micro-channel plate of a conventional image intensifier tube.

In the example of FIG. 7A, semiconductor structure 700 is depicted as a 4×4 array of EBCs. Semiconductor structure 700 is not, however, limited to this example. The number of EBCs employed in an array may be more or less than in the foregoing example, and may depend on the size of the individual EBCs and/or a desired resolution of an image intensifier.

In the examples of FIGS. 4-8, emission areas 520 are depicted as having square shapes. Emission areas 520 are not, however, limited to square shapes. Emission areas 520 may, for example, be configured as circles and/or other geometric shape(s). Each EBC and associated emission area 520 corresponds to a region of input surface 412*a* (FIG. 4), such that the array of EBCs pixelate electrons received at input surface 412*a*.

Figure 9:
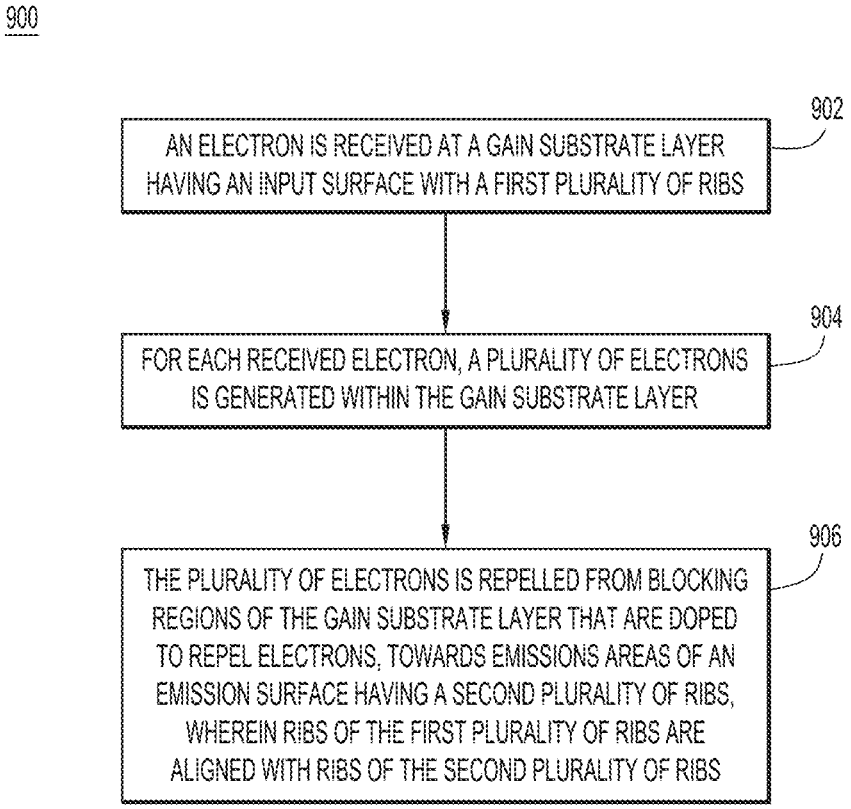
FIG. 9 is a high-level flow chart of a method for amplifying electrons using the gain substrate layer with ribs for a MEMS image intensifier, according to an example embodiment.

FIG. 9 is a flowchart of a method 900 showing operation of a mechanically robust transmission layer, and describes the example apparatus (MEMS image intensifier 400) disclosed herein. Method 900 is not, however, limited to example apparatus disclosed herein.

At operation 902, an electron is received at a gain substrate layer having an input surface with a plurality of ribs, such as described herein in one or more examples.

At operation 904, for each received electron, a plurality of electrons is generated within the gain substrate layer, such as described in one or more examples herein.

At operation 906, the plurality of electrons is repelled from blocking regions of the gain substrate layer that are doped to repel electrons, towards emissions areas of an emission surface having a second plurality of ribs, wherein ribs of the first plurality of ribs are aligned with ribs of the second plurality of ribs, such as described in one or more examples herein.

Support ribs combined with shaping of the incoming electrons and carriers within the transmission layer (gain substrate layer) can provide carrier registration and mechanical support in a transmission device. This structure has several advantages, including providing thin transmission layers, which minimizes signal loss. Additionally, other benefits include increased mechanical strength of the transmission layer, reduced gap distance (L1) spacing, and lower voltage operation. Further, by limiting complexity at least in part through reduction of the number of substrates, many common fabrication processes may be used with these techniques. These techniques provide for improving rigidity of the thin transmission layer (gain substrate layer) without degrading image quality.

The techniques disclosed herein may be implemented with/as passive devices (i.e., with little or no active circuitry or additional electrical connections). Techniques disclosed herein are compatible with conventional high temperature semiconductor processes and wafer scale processing, including conventional CMOS and wafer bonding processes, and a variety of fabrication processes.

In some aspects, support ribs present on upper or/and lower surfaces may be made of any material. Support ribs may be free-standing or connected to an adjacent substrate. Support ribs may be in any suitable configuration, including a grid of posts, or parallel lines/walls. The emission surface is less than the size of the input surface, to minimize lost carriers. Support ribs may be any suitable shape, including round, square, oval, etc. The upper and lower ribs are aligned with blocking structures to minimize or eliminate signal loss for the area consumed by the support ribs.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein. While a particular embodiment has been shown and described in detail, adaptations and modifications will be apparent to one skilled in the art. Such adaptations and modifications of the embodiment may be made without departing from the scope thereof, as set forth in the following claims.

What is claimed is:

1. An apparatus, comprising:

a semiconductor structure that includes:

a gain substrate layer doped to generate a plurality of electrons for each received electron that impinges on an input surface of the gain substrate layer;

a first plurality of ribs disposed at an input surface of the gain substrate layer;

a blocking structure disposed within the gain substrate layer that is doped to repel the plurality of electrons towards an emission area of an emission surface of the gain substrate layer;

a shielding region doped to absorb stray particles that impinge on the emission surface of the gain substrate layer, wherein the stray particles include one or more of stray photons and stray ions; and a second plurality of ribs disposed at the emission surface of the gain substrate layer.

2. The apparatus of claim 1, wherein:
each rib of the first plurality of ribs is vertically aligned with respective ribs of the second plurality of ribs.

3. The apparatus of claim 1, wherein:
each rib of the first plurality of ribs is vertically aligned with a respective blocking structure and with a respective rib of the second plurality of ribs that direct electrons along a respective channel through the gain substrate layer.

4. The apparatus of claim 1, wherein:
a gap distance between a photocathode and the first plurality of ribs is between about 100-500 μm.

5. The apparatus of claim 1, wherein:
the shielding region is doped to convert the stray particles to respective pairs of stray electrons and stray holes, and to recombine the stray electrons with the stray holes.

6. The apparatus of claim 1, wherein:
blocking structures and a background region are doped with a p-type dopant, wherein the blocking structure is more highly doped than the background region of the gain substrate layer; and
the shielding region is doped with an n-type dopant.

7. The apparatus of claim 1, wherein:
the blocking structure extends from the emission surface of the gain substrate layer towards the input surface of the gain substrate layer; and
the shielding region is within the blocking structure.

8. The apparatus of claim 1, wherein:
the gain substrate layer includes a plurality of blocking structures, each doped to repel the plurality of electrons towards respective adjacent emission areas of the emission surface of the gain substrate layer; and
each blocking structure includes a shielding region disposed next to the emission surface, with each shielding region doped to absorb stray particles that impinge the emission surface of the gain substrate layer; and
the second plurality of ribs surround the emission areas.

9. The apparatus of claim 1, wherein:
the gain substrate layer comprises channels that extend from the emission surface of the gain substrate layer toward the input surface of the gain substrate layer; and
a width of the channel is greater at the input surface than at the emission surface.

10. The apparatus of claim 9, comprising:
multiple rows of channels including first rows and second rows, wherein the first rows of channels are perpendicular to the second rows of blocking channels.

11. The apparatus of claim 1, wherein:
the gain substrate layer is configured as an array of cells configured similar to each another; and
a first cell of the array of cells includes the blocking structure, the shielding region, and the emission area.

12. The apparatus of claim 1, wherein:
the emission surface of the gain substrate layer includes a 2-dimensional array of blocking structures;
the emission surface includes a 2-dimensional array of emission areas, each emission area within a respective one of the blocking structures; and
the shielding region encompasses a remaining portion of the emission surface, and wherein the second plurality of ribs are disposed on the shielding region.

13. The apparatus of claim 1, further including:
a photocathode to convert photons to electrons and to direct the electrons toward the input surface of the gain substrate layer; and
an anode to receive the plurality of electrons from the semiconductor structure.

14. A method, comprising:
generating a plurality of electrons for a received electron that impinges on an input surface of a gain substrate layer within an electron multiplier region of the gain substrate layer, wherein a first plurality of ribs is disposed at the input surface of the gain substrate layer and a second plurality of ribs is disposed at an emission surface of the gain substrate layer to provide mechanical strength to the gain substrate layer;
repelling the plurality of electrons from blocking structures of the gain substrate layer that are doped to repel electrons, towards emissions areas of an emission surface of the gain substrate layer; and
absorbing stray particles that impinge on the emission surface of the gain substrate layer within shielding regions of the gain substrate layer that are doped to absorb photons, wherein the stray particles include one or more of stray photons and stray ions.

15. The method of claim 14, further comprising:
fabricating the first plurality of ribs and the second plurality of ribs such that respective ribs of the first plurality of ribs are vertically aligned with respective ribs of the second plurality of ribs.

16. The method of claim 14, further comprising:
fabricating the first plurality of ribs, blocking structures, and the second plurality of ribs such that respective ribs of the first plurality of ribs are vertically aligned with respective blocking structures, and respective blocking structures are vertically aligned with respective ribs of the second plurality of ribs; and
directing a flow of electrons along a respective channel through the gain substrate layer.

17. The method of claim 14, further comprising:
doping blocking structures and a background region with a p-type dopant, wherein the blocking structures are more highly doped than the background region of the gain substrate layer; and
doping the shielding regions with an n-type dopant.

18. The method of claim 17, further comprising:
doping each of a plurality of blocking structures in the gain substrate layer to repel the plurality of electrons towards respective adjacent emission areas of the emission surface of the gain substrate layer;
doping each shielding region disposed next to the emission surface, to absorb stray particles that impinge emission areas of the gain substrate layer; and
surrounding the emission areas with the second plurality of ribs.

19. The method of claim 18 wherein:
a plurality of blocking regions include multiple rows of blocking channels that extend from the emission surface of the gain substrate layer toward the input surface of the gain substrate layer.

20. The method of claim 14, wherein:
the emission surface of the gain substrate layer includes a 2-dimensional array of blocking structures;
the emission surface includes a 2-dimensional array of emission areas, each emission area within a respective one of the blocking structures; and
the shielding region encompasses a remaining portion of the emission surface, and wherein the second plurality of ribs are disposed on the shielding region.

* * * * *